US007197905B2

(12) United States Patent
Ely et al.

(10) Patent No.: US 7,197,905 B2
(45) Date of Patent: Apr. 3, 2007

(54) METER BOX LOCKING BAR ASSEMBLY

(75) Inventors: Timothy B. Ely, Fairfield, CT (US); Frederick P. Finck, Jr., Fairfield, CT (US)

(73) Assignee: Rexnord Industriess, LLC, Milwaukee, WI (US)

( * ) Notice: Subject to any disclaimer, the term of this patent is extended or adjusted under 35 U.S.C. 154(b) by 0 days.

(21) Appl. No.: 10/910,207

(22) Filed: Aug. 2, 2004

(65) Prior Publication Data

US 2006/0021395 A1 Feb. 2, 2006

(51) Int. Cl.
*B65D 55/14* (2006.01)

(52) U.S. Cl. ..... 70/164; 70/159; 70/2; 70/34; 70/63; 70/451; 70/466

(58) Field of Classification Search ..... 70/164, 70/159–161, 2, 6–14, 34, 54–56, 63, 158–173, 70/232, 370–371, 386, 451, 466, 449; 224/403
See application file for complete search history.

(56) References Cited

U.S. PATENT DOCUMENTS

| | | | | |
|---|---|---|---|---|
| 3,968,985 | A | 7/1976 | Nielsen, Jr. | |
| 4,031,722 | A | 6/1977 | Michelman | |
| 4,049,313 | A | 9/1977 | Lundberg | |
| 4,080,811 | A | 3/1978 | Nielsen, Jr. | |
| 4,096,718 | A | 6/1978 | Michelman | |
| 4,120,182 | A | 10/1978 | Michelman | |
| 4,144,729 | A * | 3/1979 | Nielsen, Jr. | 70/63 |
| 4,152,910 | A | 5/1979 | Swisher | |
| 4,254,647 | A | 3/1981 | Finck, Jr. | |
| 4,289,000 | A | 9/1981 | Nielsen, Jr. | |
| 4,413,852 | A * | 11/1983 | Burnell et al. | 292/259 R |
| 4,414,829 | A * | 11/1983 | Nielsen et al. | 70/160 |
| 4,474,041 | A * | 10/1984 | Finck, Jr. | 70/159 |
| 4,475,365 | A | 10/1984 | Swisher | |
| 4,551,999 | A * | 11/1985 | Guiler | 70/159 |
| 4,751,831 | A | 6/1988 | Morris, Jr. | |
| 4,830,414 | A | 5/1989 | Davis | |
| 5,007,258 | A * | 4/1991 | Mahaney | 70/159 |
| 5,042,856 | A * | 8/1991 | Goodman | 292/259 R |
| 5,267,688 | A | 12/1993 | Benefield | |
| 5,315,849 | A * | 5/1994 | Georgopoulos | 70/34 |
| 5,544,506 | A | 8/1996 | Nakano | |
| 5,870,911 | A * | 2/1999 | DeWalch | 70/159 |
| 5,988,722 | A * | 11/1999 | Parri | 296/26.09 |
| 6,490,892 | B1 | 12/2002 | Freiman | |
| 6,684,670 | B1 | 2/2004 | Agbay | |
| 6,722,541 | B1 * | 4/2004 | Aftanas et al. | 224/403 |

OTHER PUBLICATIONS

Inner-Title Product Data Sheet for Johnny Bar.

* cited by examiner

*Primary Examiner*—Suzanne Dino Barrett
(74) *Attorney, Agent, or Firm*—Quarles & Brady LLP

(57) ABSTRACT

A multi-meter locking bar assembly for locking a plurality of meter boxes of a gang of meter boxes includes a locking bar having opposing first and second ends. A locking device is pivotally fixed relative to the locking bar. The locking device is fixable to one of the meter boxes to lock the locking bar over at least one meter box to lock the meter box.

10 Claims, 3 Drawing Sheets

METER BOX LOCKING BAR ASSEMBLY

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

The invention relates to meter box locking devices and is directed more particularly to a locking bar assembly for use in conjunction with one or more utility meter boxes and/or similar enclosures.

There is a growing need to secure electric meter boxes or other similar utility enclosures in order to prevent the theft of utility services. Theft of electricity by tampering with or bypassing the usual electric meter connections enclosed in such meter boxes is becoming more and more common, particularly since the cost of electricity has been rising rapidly. The losses in revenue experienced by utility companies due to theft have become very high. Further, it is desirable to secure the electric meter boxes because there is a great danger to those tampering with the electric meters inside, as current of potentially deadly magnitude is involved.

Accordingly, it has become increasingly important to take all possible steps to prevent the theft and attempted theft of electricity by securing meter boxes and locking devices have been proposed for this purpose. Examples of locking devices for electric meter boxes are found in U.S. Pat. Nos. 4,096,718, 4,254,647, and 4,474,041. U.S. Pat. Nos. 4,254,647 and 4,474,041 are assigned to The Highfield Manufacturing Company, the assignee of the present invention. In these examples, a bracket is secured to the meter box using a screw that either extends through a hole drilled through the meter box wall or impinges on the meter box wall. The screw is accessed from inside the box using a screw driver, or other tool. Many of the electric meter boxes are for single residences, and thus only one meter box is present.

Multifamily residences, businesses, and other multi-tenant buildings, however, can have a plurality of meter boxes grouped in "gangs" in a small area to minimize space requirements construction costs. Ganged meter boxes are usually wall mounted and close to, or even touching, one another. An individual locking device can be used to lock each meter box of a gang of boxes. Unfortunately, this is very expensive. Moreover, if all of the meter boxes must be opened for maintenance or repair, unlocking and locking each locking device on each meter box may be tedious and time consuming.

A multi-meter locking bar, such as disclosed in U.S. Pat. No. 5,870,911, can be used to lock a plurality of meters in a row of ganged meter boxes. Unfortunately, often the meter boxes at the ends of a row of ganged meter boxes abut a wall, or other object, providing little, if any, space between the end meter boxes and the wall, or other object. As a result, a locking device necessary for securing the end meter box must be mounted on the bottom of the meter box. Known multi-meter locking bars require fittings, or some other adapting device, that allows the locking portion of the multi-meter locking bar assembly to mount on the bottom of the meter box. Adapting the known multi-meter locking bar assemblies to mount on the bottom of a meter box is often difficult and specific to the particular application. Therefore, a need exists for a multi-meter locking bar assembly that is easily mountable on the side or bottom of a meter box.

BRIEF SUMMARY OF THE INVENTION

The present invention provides a multi-meter locking bar assembly for locking a plurality of meter boxes of a gang of meter boxes. The assembly includes a locking bar having opposing first and second ends. A locking device is pivotally fixed relative to the locking bar. The locking device is fixable to one of the meter boxes to lock the locking bar over at least one meter box to lock the meter box.

A general objective of the present invention is to provide a locking bar assembly having a locking device that can be easily fixed relative to a side wall or a bottom wall of a meter box. This objective is accomplished by pivotally fixing the locking device relative to the locking bar to allow the locking device to pivot relative to the locking bar in order to be easily fixed to either a side wall or bottom wall of a meter box.

The foregoing and other objectives and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
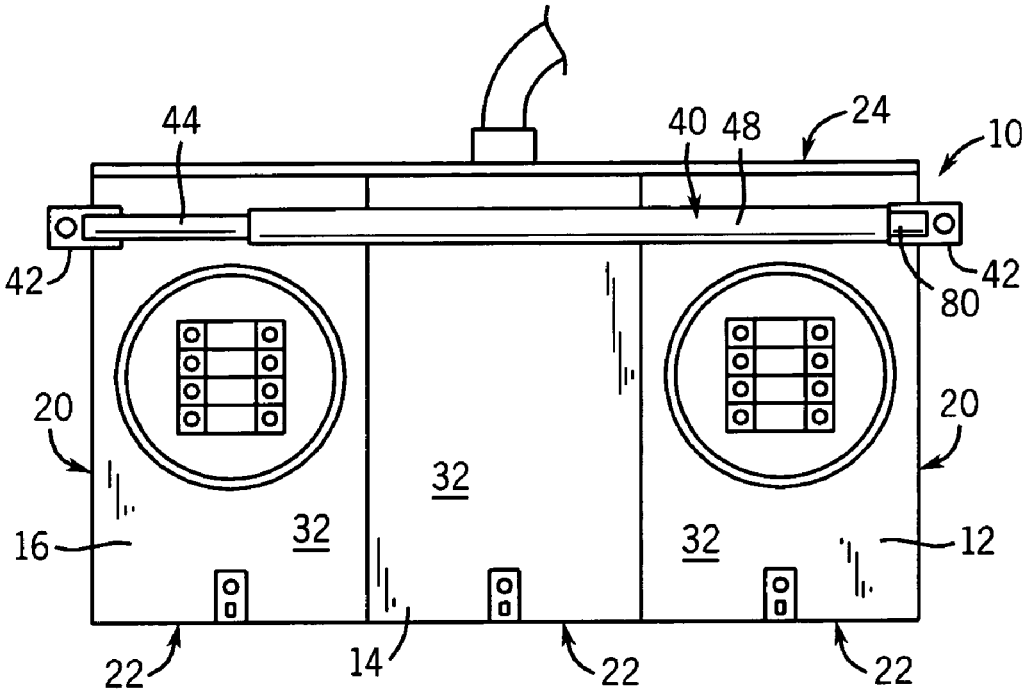
FIG. 1 is a perspective view of a multi-meter locking bar assembly incorporating the present invention fixed to side walls of end meter boxes.
Figure 2:
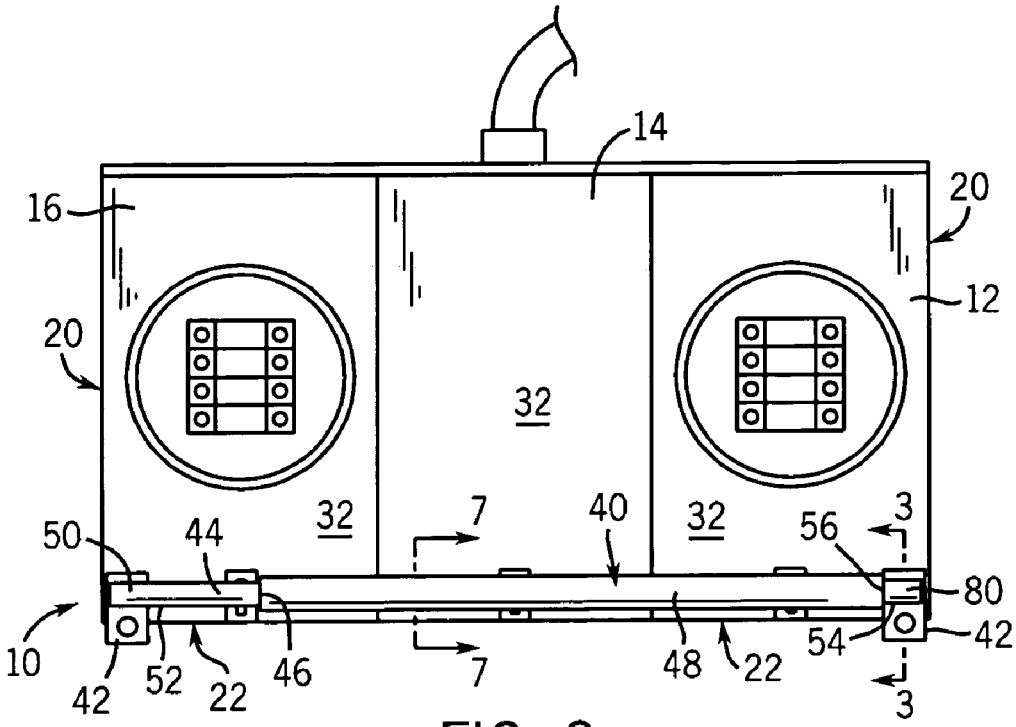
FIG. 2 is a perspective view of the multi-meter locking bar assembly of FIG. 1 fixed to bottom walls of end meter boxes.
Figure 3:
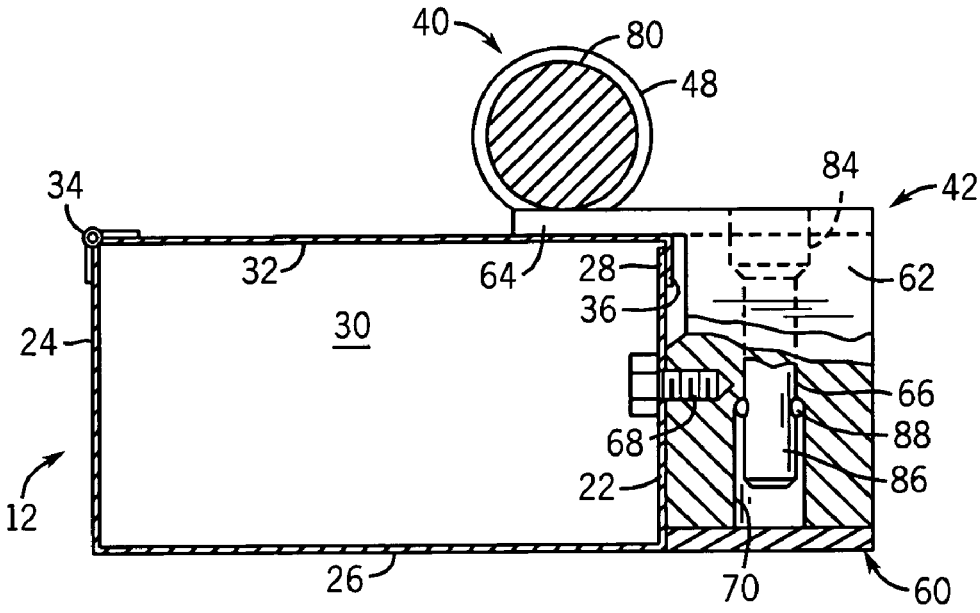
FIG. 3 is a cross sectional view along line 3—3 of FIG. 2.

A multi-meter locking bar assembly 10 shown in FIGS. 1–3 according to the invention herein is useful in maintaining a plurality of electric meter boxes 12, 14, 16, or other enclosures, in their closed condition, thereby protecting the enclosed electric meters or wiring connections from being tampered with to steal electricity. The multi-meter locking bar assembly 10 disclosed herein is especially useful for securing a plurality of meter boxes 12, 14, 16 in a gang of boxes, by mounting the locking bar assembly 10 to side walls 20 of the end meter box 12, 16 of the gang of boxes, such as shown in FIG. 1, or to bottom walls 22 of the meter boxes 12, 14, 16, such as shown in FIG. 2. This ability is especially useful if the gang of boxes abuts a wall, or other object, which prevents mounting the locking bar assembly 10 to one of a side wall 20 or bottom wall 22 of the meter boxes 12, 14, 16. Although the gang of meter boxes comprising the three meter boxes 12, 14, 16 is shown, the gang of boxes can comprise one or more meter boxes without departing from the scope of the invention.

Each electric meter box 12, 14, 16 of the gang of meter boxes is relatively standard, and with reference to FIGS. 2 and 3 only meter box 12 will be described in detail with the understanding that the description applies to all of the meter boxes 12, 14, 16. The meter box 12 includes side walls 20, a bottom wall 22, a top wall 24, and a back 26. Upper edges 28 of the walls 20, 22, 24 define an opening 30 into the meter box 12. A cover 32 is provided to cover the opening 30. The cover 32 can slip over the opening 30 or be hingedly mounted to the top wall 24 by means of a hinge 34. The cover 32 overlaps the wall upper edges 28 and is typically provided with a lip 36 which fits partially over the bottom wall 22 and side walls 20 when the electric meter box 12 is closed.

The multi-meter locking bar assembly 10 includes a locking bar 40 that is secured over the cover 32 of each meter box 12, 14, 16 to prevent the meter boxes 12, 14, 16 from being opened by an unauthorized person. The locking bar 40 is secured over the cover of each meter box 12, 14, 16 by a locking device 42, such as disclosed in U.S. Pat. Nos. U.S. Pat. Nos. 4,096,718, 4,254,647, and 4,474,041, pivotally fixed to the locking bar 40. U.S. Pat. Nos. U.S. Pat. Nos. 4,096,718, 4,254,647, and 4,474,041 are fully incorporated herein by reference.

As shown in FIGS. 2–7, in a preferred embodiment, disclosed herein, the locking bar 40 is telescopic, and includes opposing ends 52, 54. The telescopic locking bar 40 is formed from a round inner bar 44 slidably received in an open end 46 of an outer cylindrical tube 48. The inner bar 44 has an inner end (not shown) which opposes an outer end 50. The inner end of the inner bar 44 is received in the outer tube 48 through the outer tube open end 46. The outer end 50 of the inner bar 44 corresponds to one of the ends 52 of the locking bar 40 and extends out of the outer tube open end 46. The outer tube 48 includes the open end 46 and an opposing end 56. The opposing end 56 of the outer tube 48 corresponds to the opposing end 54 of the locking bar 40, and is moveable relative to the outer end 50 of the inner bar 44 to form the telescopic locking bar 40.

Figure 7:
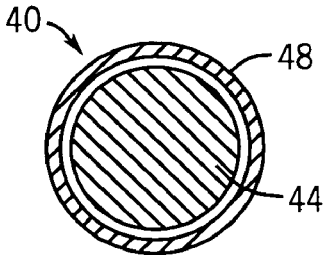
FIG. 7 is a cross sectional view along line 7—7 of the locking bar of FIG. 2.

The inner bar 44 and outer tube 48 slide relative to each other in order to vary the length of the locking bar 40 as required to secure one or more of the meter box covers 32. Although an inner bar 44 having a circular cross section slidably received in an outer tube 48 having a cylindrical cross section, such as shown in FIG. 7, is preferred, the locking bar 40 can have a fixed length or have any cross section without departing from the scope of the invention. Moreover, any method for changing the length of the locking bar 40 to secure a desired number of meter box covers 32 can be used, such as having a first locking bar section slidably engaging a slot formed in a second bar section, and the like, without departing from the scope of the invention.

Referring now to FIGS. 1–6, each locking device 42 is pivotally mounted to the locking bar 40 proximal one end 52, 54 of the locking bar 40 to secure the locking bar 40 over the meter box covers 32. In the embodiment disclosed herein, the locking devices 42 are substantially identical and only one of the locking devices 42 will be described in detail with the understanding that the description applies to both of the locking devices 42. Moreover, although a locking bar assembly 10 have two locking devices 42 is disclosed, the locking bar assembly 10 can include one or more locking devices without departing from the scope of the invention. In addition, although the locking devices 42 disclosed herein are shown proximal each end 52, 54 of the locking bar 40, any number of locking devices 42 can be pivotally and rigidly fixed to the locking bar 40 at any point along the locking bar 40 without departing from the scope of the invention.

The locking device 42 includes a lock housing 60 fixed to the bottom wall 22, as shown in FIG. 2, or a side wall 20, as shown in FIG. 1, of the meter box 12, a locking bracket 62 coupled with the lock housing 60 includes a flange 64 that extends over the cover 32, and a barrel lock 66 engaging the lock housing 60 and locking bracket 62 locks the lock housing 60 and locking bracket 62 together. Locking the lock housing 60 and locking bracket 62 relative to each other secures the locking bar 40 over the meter box covers 32 to prevent unauthorized access into the meter boxes 12, 4, 16.

The lock housing 60 is secured to the meter box 12 using any methods known in the art, such as bolting welding, detachable mounting brackets, and the like. In the embodiment disclosed in FIGS. 2–6, the lock housing 60 is secured to the bottom wall 22 of the meter box 12 by a bolt 68 extending through the meter box bottom wall 22, and includes an elongated body 70 fixed relative to the meter box 12. The body 70 includes an elongated barrel lock receptacle 74 opening to one end 76 of the body 70 for receiving the barrel lock 66. Preferably, the body 70 is formed from a case hardened material, such as steel. A seal mount (not shown) can be provided that is aligned with the receptacle 74 for receiving a seal that provides evidence of tampering if an attempt is made to remove the barrel lock 66.

Figure 6:
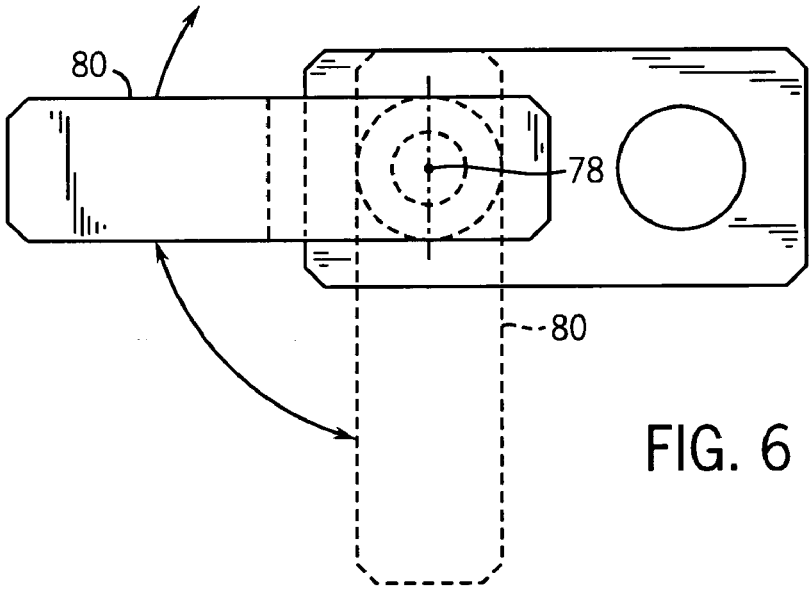
FIG. 6 is a top view of the lock device of FIG. 5.

The locking bracket 62 couples with the lock housing 60, and includes the flange 64 extending over the meter box cover 32. The flange 64 of the locking device 42 pivotally fixed relative to the outer tube 48 of the locking bar 40 is pivotally mounted to a swivel bar 80 by a screw 82 extending through the flange 64 into the swivel bar 80. The swivel bar 80 swivels, or rotates, such as shown in FIG. 6, about an axis 78 defined by the screw longitudinal axis, and is received in the open end 52, 54 of the locking bar outer tube 48 and fixed thereto, such as by welding. Although a screw 82 is disclosed for pivotally fixing the locking device 42 to the swivel bar 80 which is fixed to the locking bar 40, any mechanical fastener, such as a pin, bolt, and the like, that can pivotally fix the locking device 42 to the swivel bar 80, can be used without departing from the scope of the invention.

The flange 64 of the other locking device 42 is pivotally fixed directly to the inner bar 44 using a screw (not shown) extending through the flange 64 into the inner bar 44. Although a swivel bar 80 is used as an intermediary to fix one of the locking devices 42 to the outer tube 48, the locking devices 42 can be pivotally fixed directly to the locking bar 40 at any point along the locking bar 40 without departing from the scope of the invention.

Figure 4:
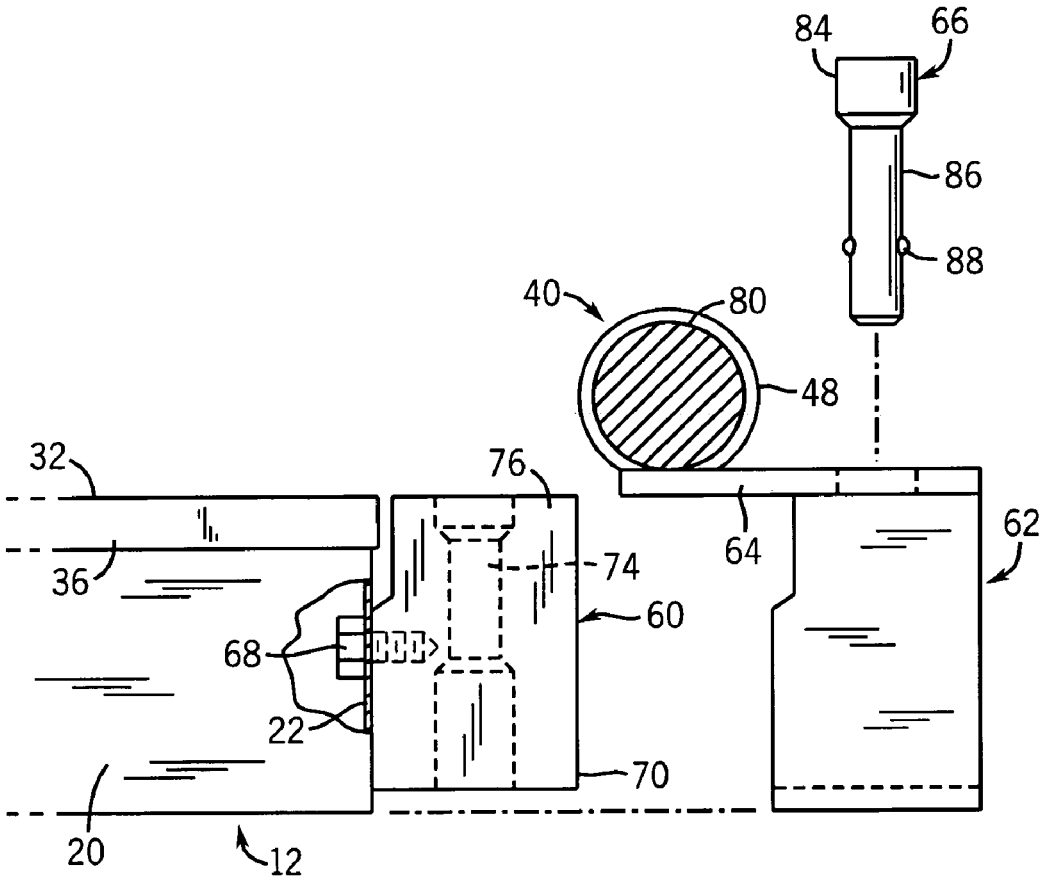
FIG. 4 is an exploded cross sectional view along line 3—3 of FIG. 2.
Figure 5:
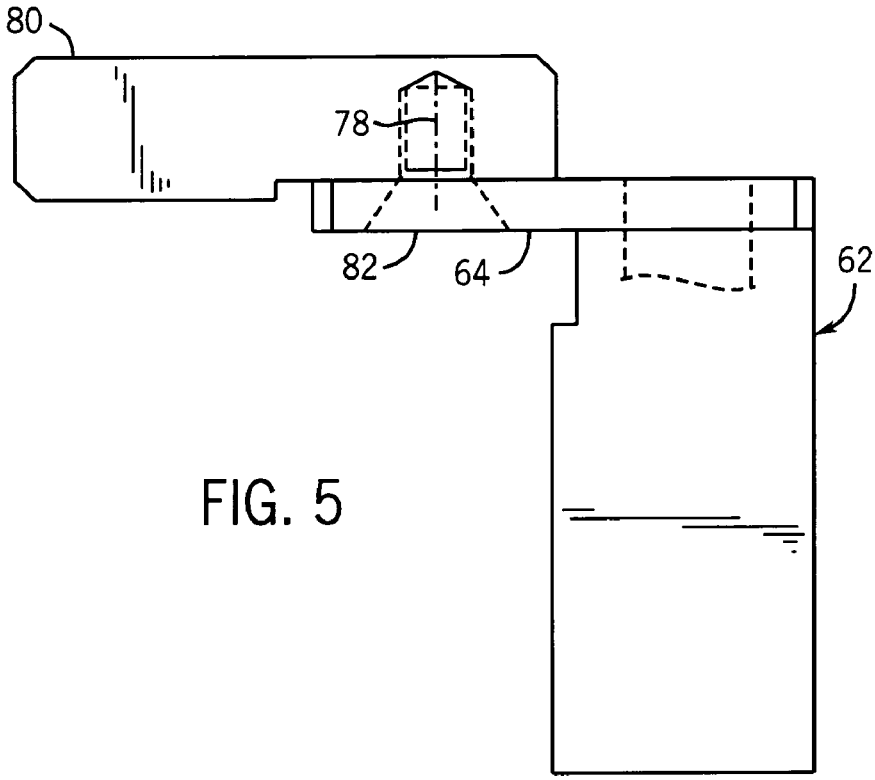
FIG. 5 is a side view of the lock device of FIG. 2.

The barrel lock 66 is received in the barrel lock receptacle 74, and engages the locking bracket 62 and lock housing 60 to lock the locking bracket 62 and lock housing 60 relative to each other. As shown in FIG. 4, the barrel lock 66 includes a head 84, a shank 86, and expansible balls 88, or other extendible structure, operated by an internal plunger actuated by a key (not shown). Several manufacturers make such locks, and they have a standard outside configuration and size, although internal parts and key structures differ between manufacturers. The barrel lock 66 can be any lock mechanism known in the art, that fits in the cavity, such as the barrel locks disclosed in U.S. Pat. Nos. 4,096,718, 4,425,647, and 4,474,041, and which are fully incorporated herein by reference.

Referring to FIGS. 1–4, in use, the plurality of meter boxes 12, 14, 16 are locked by fixing the lock housing 60 of one of the locking devices 42 to a side wall 20 (such as shown in FIG. 1) or bottom wall 22 (such as shown in FIG. 2) of the meter box 12. The lock housing 60 forming the other locking device 42 is fixed to a side wall 20 or bottom wall 22 of one of the other meter boxes 16.

The wall 20, 22 of the meter box 12, 14, 16 selected for mounting one of the lock housings 60 thereto depends on the accessibility of the walls 20, 22 for fixing the lock housing 60 to the wall. For example, the lock housing 60 is fixed to the bottom wall 22 of the meter box 12 adjacent an object or structure that prevents fixing the lock housing 60 to the side wall 20 of the meter box 12. Likewise, the lock housing 60 is fixed to the side wall 20 of the meter box 12 if an object or structure prevents fixing the lock housing 60 to the bottom wall 22 of the meter box 12. Of course, if both the side wall 20 and the bottom wall 22 of the meter box 12 are accessible, the user can choose either wall 20, 22 to use. In addition one of the lock housings 60 can be fixed to the bottom wall 22 and the other lock housing can be fixed to the side wall 20 without departing from the scope of the invention.

Once the lock housings 60 are fixed to the meter boxes 12, 16, the locking bar 40 is telescoped, such that each locking bracket 62 is aligned with one of the lock housings 60. Each locking bracket 62 is then pivoted, as required, relative to the locking bar 40, such that each of the locking brackets 62 can be coupled to one of the lock housings 60. The locking brackets 62 and lock housings 60 are then coupled together such that the locking bar 40 is positioned over the covers 32 of the meter boxes 12, 14, 16.

Once each of the locking brackets 62 is coupled with one of the lock housings 60, each barrel lock 66 is inserted into one of the barrel lock receptacles 74 and engaged with one of the coupled lock housing 60 and locking bracket 62 to lock the coupled lock housing 60 and locking bracket 62 relative to each other and secure the locking bar 40 over the covers 32 of the meter boxes 12, 14, 16. A seal can then be inserted into the seal mount, if provided, to provide evidence of tampering if unauthorized removal of the locking bar assembly is attempted.

While there have been shown and described what is at present considered the preferred embodiments of the invention, it will be obvious to those skilled in the art that various changes and modifications can be made therein without departing from the scope of the invention defined by the appended claims. For example, one end of the locking bar can be securely fixed to a wall or structure adjacent the gang of meter boxes, and the other end can have a locking device pivotally fixed thereto without departing from the scope of the invention.

We claim:

1. A multi-meter locking bar assembly for locking a plurality of meter boxes of a gang of meter boxes, said assembly comprising:

a variable length, telescopic locking bar having opposing first and second ends; and a locking device including a lock housing fixable to the plurality of meter boxes, a locking bracket removably coupled to said lock housing and fixed to said locking bar, said lock housing including a barrel lock receptacle, and a barrel lock received in said barrel lock receptacle and engaging said lock housing and locking bracket to lock said lock housing and locking bracket relative to each other.

2. The locking bar assembly as in claim 1 in which said locking device is pivotally fixed relative to said locking bar proximal one of said first and second ends.

3. The locking bar assembly as in claim 1, in which a mechanical fastener extending through said flange pivotally fixes said locking device to said locking bar.

4. The locking bar assembly as in claim 1, in a second locking device is fixed to said locking bar proximal one of said locking bar ends, said second locking device being fixable to another of the meter boxes to lock said locking bar over a plurality of the meter boxes.

5. A multi-meter locking bar assembly for locking a plurality of meter boxes of a gang of meter boxes, said assembly comprising:

a locking bar having opposing first and second ends; and a locking device including a lock housing fixable to at least one meter box of the plurality of meter boxes to lock at least one of the meter boxes, a locking bracket removably coupled to said lock housing and fixed to said locking bar, said lock housing including a barrel lock receptacle, and a barrel lock received in said barrel lock receptacle and engaging said lock housing and locking bracket to lock said lock housing and locking bracket relative to each other,said locking bracket including a flange for extending over a cover of the at least one meter box being locked, and said locking bar being pivotally fixed to said flange.

6. The locking bar assembly as in claim 5, in which said flange is pivotally fixed to a swivel bar rigidly fixed to an end of said locking bar.

7. A multi-meter locking bar assembly comprising:

a variable length, telescopic locking bar having opposing first and second ends; and a locking device fixable to a first meter box to lock said locking bar over a gang of meter boxes to lock at least one of said meter boxes of said gang of meter boxes, said locking device including a lock housing fixable to the first meter box, a locking bracket removably coupled to said lock housing and fixed to said locking bar, said lock housing including a barrel lock receptacle for receiving a barrel lock, and a barrel lock received in said barrel lock receptacle and engaging said lock housing and locking bracket to lock said lock housing and locking bracket to each other.

8. The locking bar assembly as in claim 7, in which said locking bracket includes a flange for extending over a cover of the meter box being locked, and said flange is pivotally fixed to said locking bar.

9. The locking bar assembly as in claim 8, in which said flange is pivotally fixed to a swivel bar rigidly fixed to an end of said locking bar.

10. The locking bar assembly as in claim 9, in which a mechanical fastener extending through said flange into said swivel bar pivotally fixes said locking device to said locking bar.

* * * * *